US005808594A

United States Patent [19]

Tsuboyama et al.

[11] Patent Number: 5,808,594

[45] Date of Patent: Sep. 15, 1998

[54] DRIVING METHOD FOR DISPLAY DEVICE AND DISPLAY APPARATUS

[75] Inventors: Akira Tsuboyama; Kazunori Katakura, both of Atsugi; Manabu Iwasaki, Yokohama, all of Japan

[73] Assignee: Canon Kabushiki Kaisha, Tokyo, Japan

[21] Appl. No.: 534,043

[22] Filed: Sep. 26, 1995

[30] Foreign Application Priority Data

Sep. 26, 1994 [JP] Japan ..... 6-257594

[51] Int. Cl.[6] ..... G09G 3/36

[52] U.S. Cl. ..... 345/89; 345/149

[58] Field of Search ..... 345/147, 148, 345/149, 103, 67, 87, 88, 89, 98, 99, 100, 94, 9, 96, 208, 210

[56] References Cited

U.S. PATENT DOCUMENTS

| | | | |
|---|---|---|---|
| 4,674,839 | 6/1987 | Tsuboyama et al. | 350/334 |
| 4,709,995 | 12/1987 | Kuribayashi et al. | 350/350 |
| 4,712,877 | 12/1987 | Okada et al. | 350/350 |
| 4,776,676 | 10/1988 | Inoue et al. | 250/350 |
| 4,796,890 | 1/1989 | Snyder | 273/144 |
| 4,824,218 | 4/1989 | Kuno et al. | 359/350 |
| 4,902,107 | 2/1990 | Tsuboyama et al. | 350/350 |
| 5,026,144 | 6/1991 | Taniguchi et al. | 350/350 |
| 5,033,822 | 7/1991 | Ooki et al. | 350/331 |
| 5,041,821 | 8/1991 | Onitsuka et al. | 340/784 |
| 5,058,994 | 10/1991 | Mihara et al. | 359/56 |
| 5,091,723 | 2/1992 | Kanno et al. | 340/784 |
| 5,262,082 | 11/1993 | Janulis et al. | 252/299.01 |
| 5,321,419 | 6/1994 | Katakura et al. | 345/97 |
| 5,359,344 | 10/1994 | Inoue et al. | 345/100 |
| 5,435,250 | 7/1995 | Pollock | 102/317 |
| 5,469,281 | 11/1995 | Katakura et al. | 359/56 |
| 5,471,229 | 11/1995 | Okada et al. | 345/89 |
| 5,488,387 | 1/1996 | Maeda et al. | 345/149 |

FOREIGN PATENT DOCUMENTS

| | | | |
|---|---|---|---|
| 0361981 | 4/1990 | European Pat. Off. . | |
| 0573822 | 12/1993 | European Pat. Off. . | |
| 0673012 | 9/1995 | European Pat. Off. . | |
| 5-127623 | 5/1993 | Japan | 345/103 |

*Primary Examiner*—Xiao Wu

*Attorney, Agent, or Firm*—Fitzpatrick, Cella, Harper & Scinto

[57] ABSTRACT

A display device is constituted by scanning lines arranged to form plural pixels including at least two types of pixels having mutually different areas inclusive of larger pixels and smaller pixels. The display device is driven by a driving method including a vertical scanning period wherein only scanning lines corresponding to the larger pixels are vertically scanned.

26 Claims, 10 Drawing Sheets

$S_1 : S_2 : S_3 : S_4$
$= 8 : 4 : 2 : 1$
$l_1 : l_2 : l_3 : l_4$
$= 8 : 4 : 2 : 1$ $S_1 : S_2 : S_3 : S_4$
$= 8 : 4 : 2 : 1$
$l_1 : l_2 = 2 : 1$
$l_3 : l_4 = 4 : 1$ $S_1 : S_2 : S_3 = 2 : 1 : 2$

DRIVING METHOD FOR DISPLAY DEVICE AND DISPLAY APPARATUS

FIELD OF THE INVENTION AND RELATED ART

The present invention relates to a driving method for a display device suitable for use in computer displays, view finders for video camera recorders, television receivers, light valves for video projectors, etc., and a display apparatus including means for such a driving method.

Hitherto, various proposals have been made regarding a method of realizing a multi-level gradation on a liquid crystal display device (LCD) inclusive of the following.

(1) In a first type of method, an applied voltage to respective pixels is controlled according to an applied voltage-transmittance curve to obtain a desired level of luminance at the respective pixels.

This is typically adopted in an active matrix-type LCD using a TN (twisted nematic) liquid crystal. Further, in the case of using a ferroelectric chiral smectic liquid crystal, a method of changing an areal ratio between domains in two orientation states has been proposed, e.g., as disclosed in U.S. Pat. Nos. 4,712,877, 4,796,890, 4,824,218, and 4,776,676.

In the above-described method (1), however, if the applied voltage-transmittance curve is very steep, a large change in luminance occurs in response to a slight fluctuation in applied voltage, so that it is difficult to accurately display a desired level of luminance.

(2) In a second type of method, one frame scanning is divided into plural sub-frames of scanning so as to modulate an ON/OFF time ratio to effect a multi-level gradational display, e.g., as disclosed in U.S. Pat. No. 4,709,995. In the method (2), however, some difficulties can be encountered, such that the circuit becomes complicated and a high-speed scanning is required in order to suppress the occurrence of flicker, thereby posing a large load on the display device and the peripheral circuit therefor.

Other methods include (3) a method using display units (or pixels) each including plural pixels (or sub-pixels) having different areas and turning on the plural pixels (or sub-pixels) in various patterns to display multiple gradation levels, as disclosed in European non-examined application publications EP-A 261898, EP-A 361,981 and EP-A 453,033.

Specific examples of the method (3) and characteristics thereof will be described with reference to FIGS. 1A–1C and FIG. 2, each intended to display 16 levels of gradational display. Further, in each type, pixel division areal ratios can be varied depending on the intended use of the product display device.

Each of the above-mentioned examples of the display device for the method (3) is characterized by a whole picture area in which at least two types of pixels are present in mixture. From another aspect, it is also possible to regard that each pixel (or display unit) is composed of at least two sub-pixels (or pixels). These are two expressions having substantially the same meaning.

The description hereinafter will be made generally based on the latter expression.

In each of the specific examples shown in FIGS. 1A and 1B, four sub-pixels are used as a unit to constitute a pixel capable of displaying multi-gradation levels. In order to obtain 16 linear optical levels of 0–15, these sub-pixels are set to have areal ratios of 8:4:2:1, and electrodes corresponding to the respective sub-pixels are selectively and sequentially driven depending on given image data.

The examples of FIGS. 1A and 1B are different from each other only in arrangement of the four sub-pixels. More specifically, the sub-pixels shown in the example of FIG. 1A, for example, are formed at intersections of four scanning electrodes and one data electrode while setting the widths of the scanning electrodes in ratios of 8:4:2:1 in order to provide the above-mentioned areal ratios among the sub-pixels. These two types of electrodes may be disposed on a pair of oppositely disposed substrate in a known manner.

Incidentally, linear optical levels may generally be obtained by setting the areal ratios of sub-pixels to satisfy $2^n:2^{n-1}: \ldots : 2^1:2^0$. In this method, an image processing method such as the dither method or the average concentration method may be further used in combination in order to obtain a more natural image.

In the specific example shown in FIG. 1C, 9 sub-pixels having areal ratios as shown are used as a unit (a pixel), and electrodes corresponding to the sub-pixels having different areas are driven selectively and sequentially depending on given image data. As a result, as shown in FIG. 2. White display sub-pixels are disposed symmetrically vertically and horizontally. Accordingly, in the case of this sub-pixel arrangement pattern, a center of ON region (white display portion) is always at the center of the pixel (including 9 sub-pixels) at any gradation level. As a result, it is possible to obviate an image quality deterioration of so-called "false contour" caused when an optical gravitation center is shifted remarkably depending on a gradation pattern.

These display devices having (sub-)pixel arrangement patterns as described above have been conventionally driven in a multiplex manner wherein the scanning lines are selected one by one vertically sequentially from the top to the bottom of an entire picture area.

In such a conventional method of driving a display device including pixels each divided into plural sub-pixels wherein divisional scanning electrodes corresponding to the respective sub-pixels are scanned selectively and sequentially to effect a multi-level gradational display, one frame scanning period for drawing one picture is prolonged because of an increased number of scanning lines due to division of the scanning electrodes, thereby being liable to result in inferior image qualities, such as occurrence of flicker or failure to follow a motion picture display speed.

Further, in such a conventional driving method, similar problems are liable to be caused, also in the case of effecting a partial rewrite by a vertical scanning with preferential drive of scanning electrodes corresponding to an image region where the image data is changed.

SUMMARY OF THE INVENTION

In view of the above-mentioned problems, an object of the present invention is to provide a driving method for a display device for multi-level gradational display including pixels each divided into plural sub-pixels having different areas, capable of obviating image quality deterioration due to an increased number of scanning lines, thereby allowing a high-quality image display.

Another object of the present invention is to provide a display apparatus constituted to drive such a display device according to such a driving method.

According to an aspect of the present invention, there is provided a driving method for a display device of the type including scanning lines arranged to form plural pixels comprising at least two types of pixels having mutually different areas inclusive of larger pixels and smaller pixels, said driving method comprising effecting a frame display by preferentially vertically scanning scanning lines corresponding to the larger pixels.

According to another aspect of the present invention, there is provided a driving method for a display device of the type including scanning lines arranged to form plural pixels comprising at least two types of pixels having mutually different areas inclusive of larger pixels and smaller pixels, said driving method comprising a vertical scanning period wherein only scanning lines corresponding to the larger pixels are vertically scanned.

According to a further aspect of the present invention, there is provided a display apparatus comprising a display device of the type described above, and drive means for driving the display device according to any of the driving methods described above.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

A preferred embodiment of the driving method for a display device according to the present invention adopts display mode including a vertical scanning period wherein only scanning lines corresponding to pixels of the largest area are selected for scanning. According to a driving method and a display apparatus of this embodiment, it becomes possible to effect one frame display without lowering the frame frequency, thus obviating the occurrence of flicker.

Further, by preferentially scanning the scanning lines of the largest area, thus exhibiting the highest contribution to luminance, it becomes possible to obviate disruption or deviation of display between frames, thereby providing a smoother motion picture display and an effectively higher drawing or displaying speed.

Hereinbelow, the present invention will be described in further detail with reference to the drawings.

Figure 3:
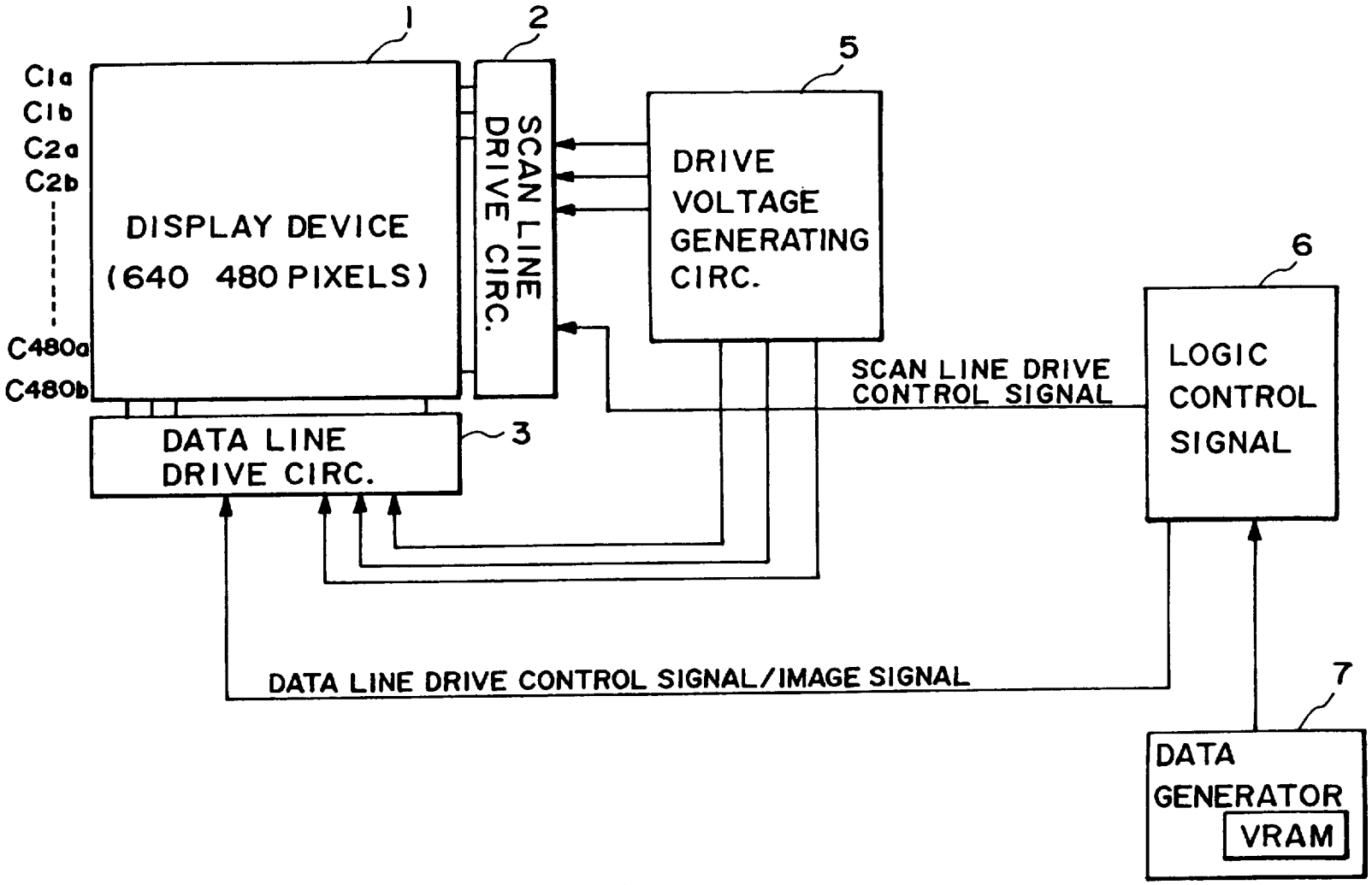
FIG. 3 is a block diagram of a control system used in an embodiment of the display apparatus according to the invention.
Figure 4:
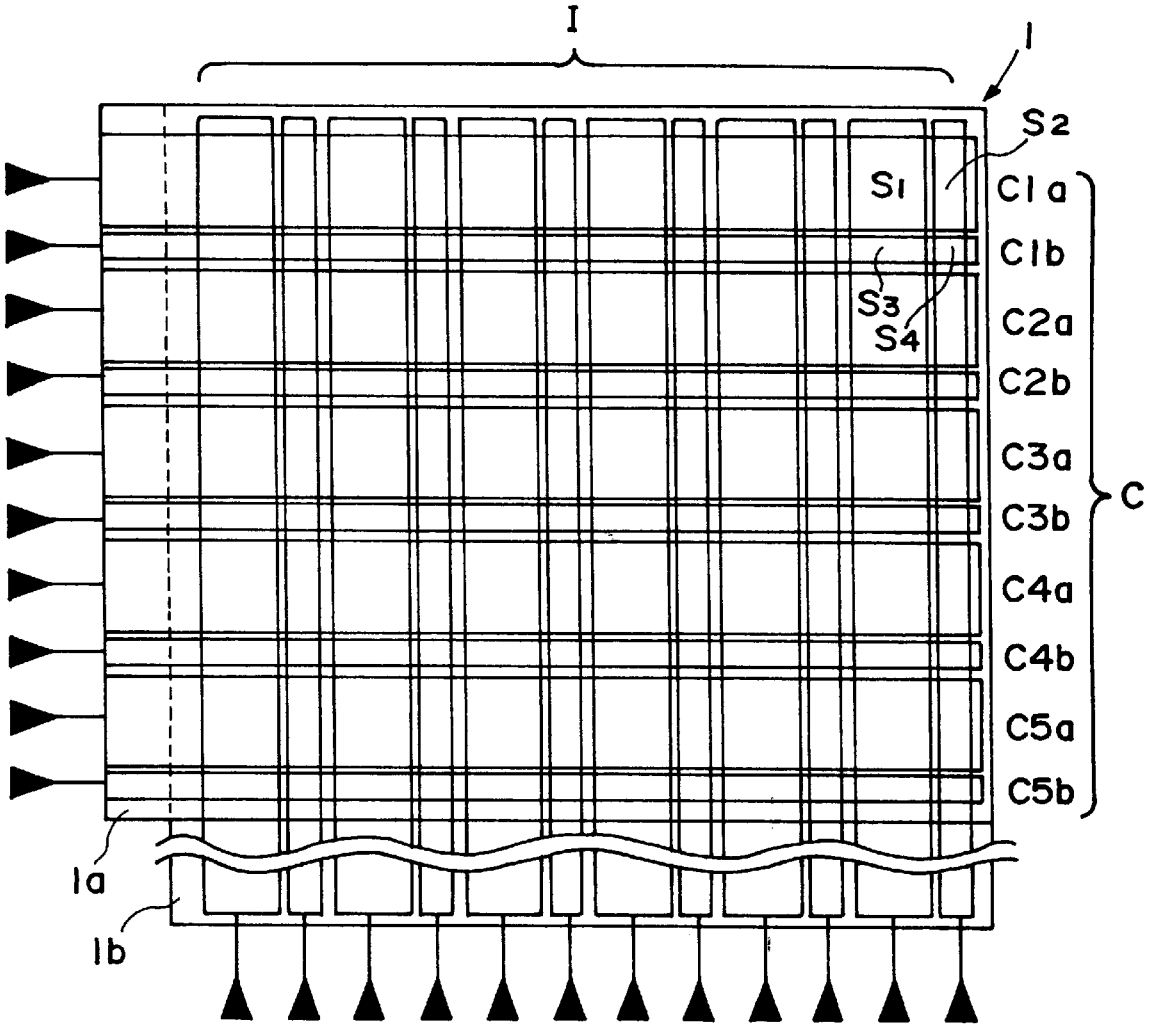
FIG. 4 is a schematic planar illustration of an example display device used in the invention.

FIG. 3 is a block diagram of a drive system for an embodiment of the display apparatus according to the present invention, and FIG. 4 is a schematic plan view for illustrating a part of a liquid crystal display device used in the display apparatus.

Referring to FIGS. 3 and 4, the display apparatus includes a liquid crystal display device 1 comprising a substrate la having thereon scanning electrodes C (as scanning lines) and a substrate 1*b* having thereon data electrodes I (as data lines), and a drive system (i.e., drive means) therefor including a scanning line drive circuit 2 for driving the scanning electrodes C, a data line drive circuit 3 for driving the data electrodes I, a drive voltage generating circuit 5 for supplying drive voltages to the respective drive circuits, a logic control circuit 6 for supplying a scanning line drive control signal to the scanning line drive circuit 2 and supplying a data line control signal and image signals to the data line drive circuit 3, and a data generating unit 7 equipped with a VRAM for supplying image data to the logic control circuit 6.

In this embodiment, the liquid crystal display device 1 actually includes 640×480 pixels (while only 6×5 pixels are shown in FIG. 4), and each pixel is composed of plural sub-pixels having different areas each formed by an intersection of the opposing electrodes of the substrates 1*a* and 1*b*.

Figure 1A:
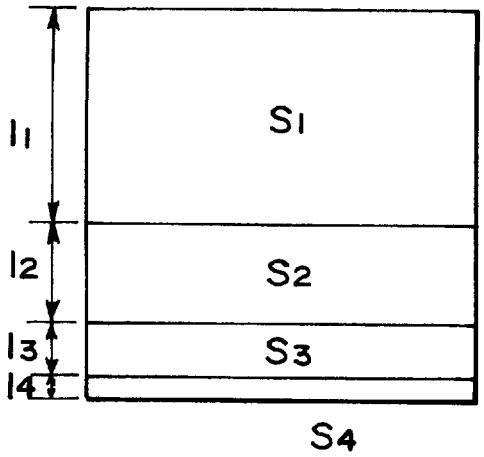
FIGS. 1A–1C respectively show an example of sub-pixel arrangement in a pixel (display unit) for gradational display.
Figure 1B:
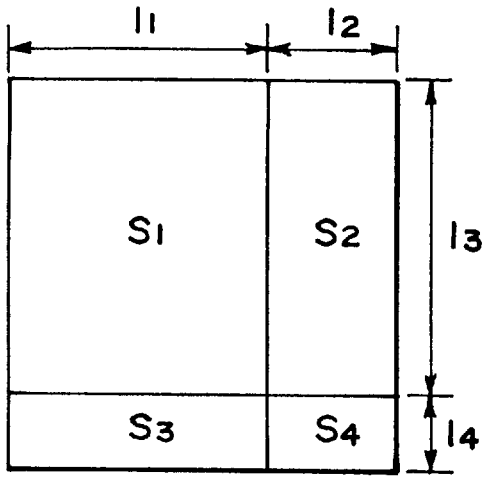
Figure 1C:
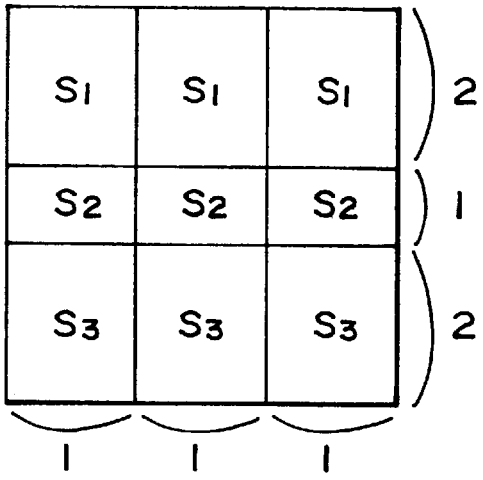

As shown in FIG. 4, in this embodiment, each pixel of the liquid crystal display device 1 is divided into 4 sub-pixels having areal ratios as shown in FIG. 1B. In other words, the scanning electrodes C and data electrodes forming sub-pixels at their intersections are formed in two widths respectively so as to correspond to the four areas of the respective sub-pixels.

For a simpler comprehension, FIG. 4 shows a simpler arrangement composed of 6×5 pixels. In this arrangement, the data electrode and scanning electrode constituting each pixel are each divided into two electrodes, so that totally 10 scanning lines are formed so as to receive a scanning signal, and one line scanning period is designed to be 70 μsec.

In case here a motion picture display as in television is performed according to a conventional driving method of completing a display for each pixel y an a-b line scanning wherein scanning is performed in the order of C1*a*→C1*b*→C2*a*→C2*b*→C3*a*→C3*b*→C4*a*→C4*b*→C5*a*→C5*b*→. . . .→C480*a*→C480*b*, the frame frequency becomes ca. 15 Hz which is almost a half of 30 Hz that is a frame frequency required to avoid a flicker, so that an observable flicker is caused. Further, because of a low displaying (or drawing) speed of only 15 Hz, image data supplied at a frequency of 30 Hz is thinned, thus failing to provide a normal motion picture.

In contrast thereto, in a preferred embodiment of the driving method according to the present invention, scanning electrodes corresponding to the sub-pixels having the largest area among all the sub-pixels constituting the pixels are preferentially driven by vertical scanning to effect one frame scanning. More specifically, in this embodiment, the scanning electrodes C are divided or classified into two types of a lines and b lines, and only the a lines corresponding to the sub-pixels of a larger area are scanned in the order of C1*a*→C2*a*→C3*a*→C4*a*→C5*a*→ . . . →C480*a*.

As for an observability of a motion picture display, as the a lines corresponding to the sub-pixels of the largest area having the largest contribution to the luminance are preferentially scanned at a frequency of 30 Hz, a disruption or deviation of display between frames can be obviated, thereby providing a relatively smooth motion picture display and an effectively higher displaying speed.

In this way, according to this embodiment of the driving method of the present invention, it becomes possible to obviate an image quality deterioration. Further, as only the a lines among all the scanning lines are scan-selected, the parasitic capacitance of the electrodes is reduced, thereby reducing a disorder in waveform and a signal delay and also reducing a load to the drive circuit.

In case of effecting a motion picture display on the entire picture area, among all the scanning lines corresponding to the entire picture area, the scanning lines C1*a*, C2*a*, C3*a*, . . . C480*a* corresponding to the sub-pixel S1 having the largest area are sequentially supplied with a scanning selection signal and, in synchronism therewith, display signals for determining display states are applied to data lines corresponding to the sub-pixels S1 and S2.

In order to increase the effective aperture rate and increase the luminance of the picture even by decreasing the number of gradation levels, it is possible to apply to data lines corresponding to the sub-pixels S2 data signals identical to those applied to the data lines corresponding to the sub-pixels S1. As a result, the sub-pixels S2 are caused to have identical display states (identical orientation states of the liquid crystal) as the sub-pixels S1.

Further, in case where the flicker is desired to be suppressed more completely, it may be appropriate to scan the scanning lines corresponding to the scanning lines corresponding to the sub-pixels S1 and S2 by two vertical scannings. In this instance, the scanning lines C1*a*, C3*a*, C5*a*, . . . C477*a* and C479*a* are sequentially scanned in a first vertical scanning while skipping the remaining scanning lines. In a second vertical scanning, the scanning lines C2*a*, C4*a*, . . . C478*a* and C480*a* are sequentially scanned in a second vertical scanning while skipping the remaining scanning lines.

It is of course possible to effect three vertical scannings so as to first sequentially scan C1*a*, C4*a*, . . . C478*a*; then sequentially scan C2*a*, C5*a*, . . . C479*a*; and finally sequentially scan C3*a*, C6*a*, . . . C480*a*, thereby further increasing the frequency of vertical scanning.

The present invention is also effective in the case of rewriting the display states of only pixels in a partial region corresponding to, e.g., the scanning lines C101*a*–C200*a* among the total picture area. Such a partial rewrite of display state is effective, e.g., in case of setting a window in a picture for performing a certain task of a computer and displaying a video motion picture in the window. In addition to such a video motion picture display, it is also effective in turning on/off or movement of a cursor or in window scrawling.

In the case of a motion picture display on the entire picture area, it is appropriate to repeat the above-mentioned vertical scanning with skipping of scanning lines.

On the other hand, in the case of displaying a motion picture in a partial region in the entire picture area, it may be also appropriate to vertically scan all the scanning lines corresponding to the larger sub-pixels in the partial region without skipping.

In the case of a display device using an optical modulation material such as a chiral smectic liquid crystal, it is appropriate to effect a refresh scanning of repeating a vertical scanning in a prescribed period even when the image is not rewritten in order to prevent the sticking of the optical modulation material. In this case, the pixels on a selected scanning line are once reset into a bright or dark state and then rewritten into the original display states. As a result, it is possible to prevent the optical modulation substance being mono-stabilized into one optical state.

Hereinabove, the scanning scheme according to the first display mode of the present invention has been described. The scanning scheme may appropriately be selected by manipulating a display mode selection switch by a user himself. The switch may be a mechanical one or an electrical one, or may be manipulated by software.

In the case of selecting a second display mode using a scanning scheme different from the above-mentioned scheme, the scanning lines may be selected in the order of C1*a*, C1*b*, C2*a*, C2*b*, C3*a*, C3*b*, . . . , C480*a* and C480*b*. If a user is concerned with flicker, he may select a selection sequence of C1*a*, C1*b*, C3*a*, C3*b*, C5*a*, C5*b*, . . . , C479*a*, C479*b*, C2*a*, C2*b*, C4*a*, C4*b*, C6*a*, C6*b*, . . . , C480*a* and C480*b*. In other words, two scanning lines for four sub-pixels S1, S2, S3 and S4 are regarded as a bundle, and the scanning line bundles may be selected sequentially with skipping of one or more bundles apart.

As described above, an embodiment of the display apparatus according to the present invention may include at least two display modes including one adopting the above-mentioned scanning scheme according to the first display mode.

Now, a third display mode obtained by modifying the first display mode will be described. In the third mode, a frame scanning may be composed of a first field of sequentially scanning only a lines, i.e., C1*a*, C2*a*, C3*a*, . . . C480*a*; a second field of again sequentially scanning only the a lines; and a third field of scanning only b lines of C1*b*, C2*b*, C3*b*, . . . , C480*b*.

The above mode can be further modified so that one frame is composed of first to third fields of scanning only the a lines, respectively and a fourth field of sequentially scanning only the b lines.

In the third mode described above, the all scanning lines are selected while the a lines corresponding to the larger sub-pixels are preferentially selected, so that the above-mentioned second mode need not be present. In this case, a mode selection switch can be unnecessitated.

It is also possible to design a system so as to select any of the display modes automatically depending on the kinds of image data to be displayed. Such a display mode selection may be effected by adding a changeover circuit including a memory storing a software execution program and a controller. It is also preferred to effect control of switching from the second display mode to the first display mode when the number of partially rewritten scanning lines exceeds a prescribed number. Further, when the first mode is selected by switching from the other modes, it is preferred to select the scanning lines (e.g., the b lines) not selected in the first display mode and reset the pixels on the scanning lines into either the bright or dark display state prior to starting the scanning according to the first display mode.

The above-described display operation may be performed by connecting a display device to a scanning line drive circuit and a data line drive circuit, and to a control circuit and supplying scanning line address data and display data to the scanning line drive circuit and the data line drive circuit as disclosed in, e.g., U.S. Pat. Nos. 5,091,723, 5,058,994, 5,435,250 and 5,359,344. These circuits are generally composed of a large number of IC chips. The scanning line drive circuit having therein an address decoder functions to decode scanning line address data, apply a scanning selection signal to a selected scanning line and apply a scanning non-selection signal to the remaining scanning lines.

Examples of the display device used in the present invention may include those using a liquid crystal or an electrochromic material as an optical modulation material, a DMD device using micro-mirrors, a plasma device, and an electron-emission device.

The scanning lines referred to herein may be scanning electrodes of simple-matrix or active matrix devices, and may also refer to scanning traces with light beam or plasma in the case of a photo-address device using a photoconductor film or a plasma device similarly as in a CRT. In the case of a photo-address type device comprising a photoconductor film, the pixels may be regarded as being integrated without data lines.

Accordingly, the scanning selection signal used in the present invention may be composed of a photo-signal or an electric signal adapted to a display device used.

Hereinbelow, a non-active matrix-type liquid crystal display device will be described as an example of the display device used in the present invention.

A liquid crystal device used in the present invention may be formed as a liquid crystal cell or panel comprising a pair of oppositely disposed substrates each having thereon a plurality of electrodes constituting scanning lines or data lines and an alignment thereon, and a liquid crystal material disposed therebetween by injection.

The substrates constituting such a liquid crystal device may be composed of semiconductor, glass, quartz or plastic, and at least one thereof may desirably be transparent.

Further, at least one of opposing electrodes constituting each pixel may preferably comprise a transparent conductor, suitable examples of which may include: tin oxide, indium oxide and indium-tin-oxide (ITO). Further, according to necessity, each stripe of transparent electrode may be accompanied with a narrower strip of low-resistivity metal. The electrodes may preferably have a thickness of ca. 40–200 nm.

The alignment film for controlling alignment of liquid crystal molecules may comprise a film of an organic material, such as polyimide, polypyrrole, polyvinyl alcohol, polyamideimide, polyesterimide, polyparaxylylene, polyester, polycarbonate, polyvinyl acetal, polyvinyl chloride, polyamide, polystyrene, cellulosic resin, acrylic resin, or melamine resin; or an inorganic film, such as an obliquely vapor-deposited film of SiO. The thickness may desirably be ca. 5–100 nm.

The alignment film may preferably be subjected to rubbing in order to provide a desired range of pretilt angle to liquid crystal molecules at the boundary.

(Preparation of liquid crystal cell)

A liquid crystal cell (or panel) may be prepared in the following manner. A transparent substrate of, e.g., glass is coated with a transparent conductor film by a vapor deposition process, such as CVD, sputtering or ion plating, and the conductor film is patterned into stripes, which are then coated with an insulating film by a vapor deposition process as described above or wet-application, and then with a solution containing fine particles dispersed therein applied by printing, followed by pre-baking and curing to form a roughened surface. An alignment film is further formed thereon by spinner coating of, e.g., a polyamide acid solution, followed by baking. The film is then subjected to rubbing. A pair of substrates may be respectively treated in the above-described manner. On one of the pair of substrates, spacer beads may be dispersed, and a sealant is applied on the periphery thereof, and the other substrate is applied thereto to form a blank cell. Then, a liquid crystal material is injected into the blank cell through an injection port thereof and, after sealing the injection port, is gradually cooled into a desired operating phase, such as chiral smectic phase.

An example of the liquid crystal device capable of enjoying the most noticeable effect according to the present invention may be a non-active matrix-type device using chiral smectic liquid crystal. The chiral smectic liquid crystal device may be classified into two types according to a smectic layer structure contained therein, i.e., one containing a chevron layer structure and the other containing a bookshelf structure. The latter type may be preferred because of a higher transmittance.

A preferred example of the liquid crystal material used may be a liquid crystal composition containing a fluorine-containing mesomorphic compound (perfluoroether mesomorphic compound) containing a fluorocarbon terminal portion and a hydrocarbon terminal portion connected with a central core, having a smectic intermediate phase or potential smectic intermediate phase, and containing an ether-type oxygen in the fluorocarbon terminal chain (described in U.S. Pat. No. 5,262,082 and PCT International Patent WO 93/22396, and reported by Marc D. Radcliff, et al in 1993 Fourth International Ferroelectric Liquid Crystal International Conference P-46).

Such a liquid crystal material may be characterized by a phase transition series lacking cholesteric phase on temperature decrease, i.e., causing a phase conversion from isotropic phase into smectic A phase without mediating cholesteric phase in the course of temperature decrease.

In case of using such a liquid crystal material, it is also preferred to use a pair of substrates, only one of which is provided with an alignment film having a strong alignment control force as represented by a rubbed polyimide film. The other substrate may be free from an alignment film or an alignment film having only a weak alignment control force, inclusive of a rubbed film.

In case of using a pair of substrates each having a rubbed alignment films, the rubbing directions may preferably intersect at an angle of 1–10 degrees.

A liquid crystal cell (or panel) prepared in the above-described manner may be sandwiched between a pair of polarizers disposed in cross nicols to provide a liquid crystal device capable of providing a bright and a dark state depending on the orientation states of the liquid crystal molecules.

Now, an example set of scanning signal and data signals will be described with reference to the case of driving a chiral smectic liquid crystal device.

Figure 5:
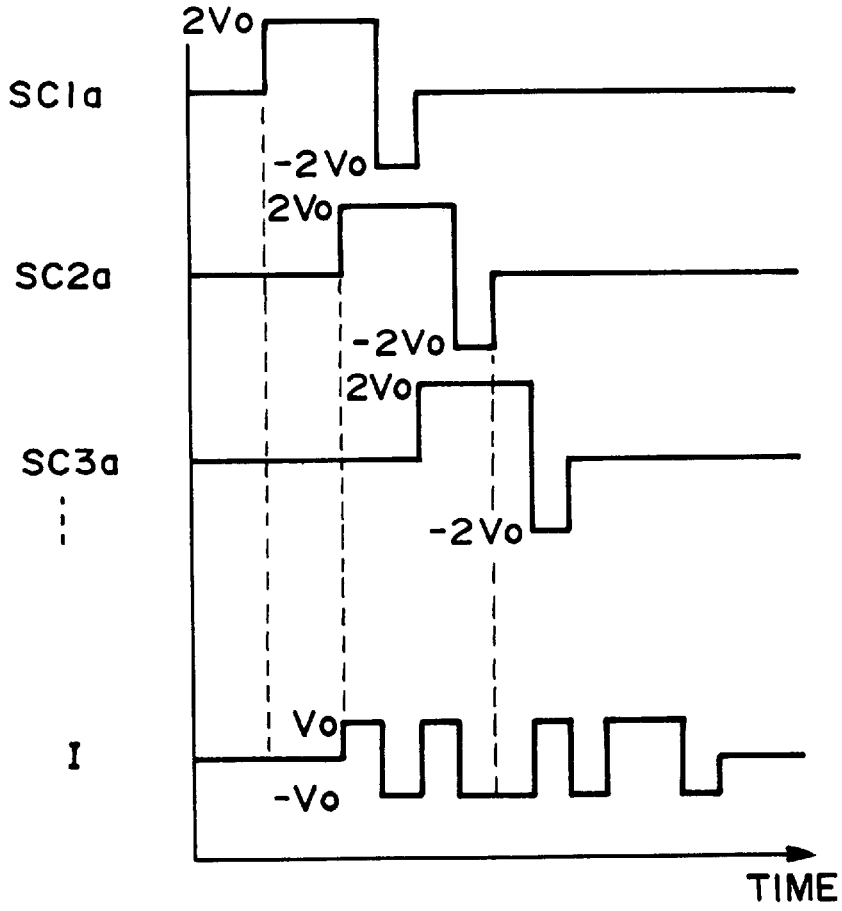
FIGS. 5 and 6 are respectively a time-serial waveform illustrating an example set of drive signals used in the invention.

FIG. 5 shows scanning signals and data signals. More specifically, at SC1*a*, SC2*a* and SC3*a* is shown a scanning signal sequentially applied to scanning lines SC1*a*, SC2*a* and SC3*a*, and at I are shown data signals successively applied to a data line I. A scanning selection signal comprises a pulse with a voltage 2 $V_0$ for a reset pulse for resetting the pixels on a scanning line and a writing pulse with a voltage −2 $V_0$ for writing in pixels. A reference voltage of zero volt (which may be called a scanning non-selection signal) is applied to non-selected scanning lines.

Figure 6:
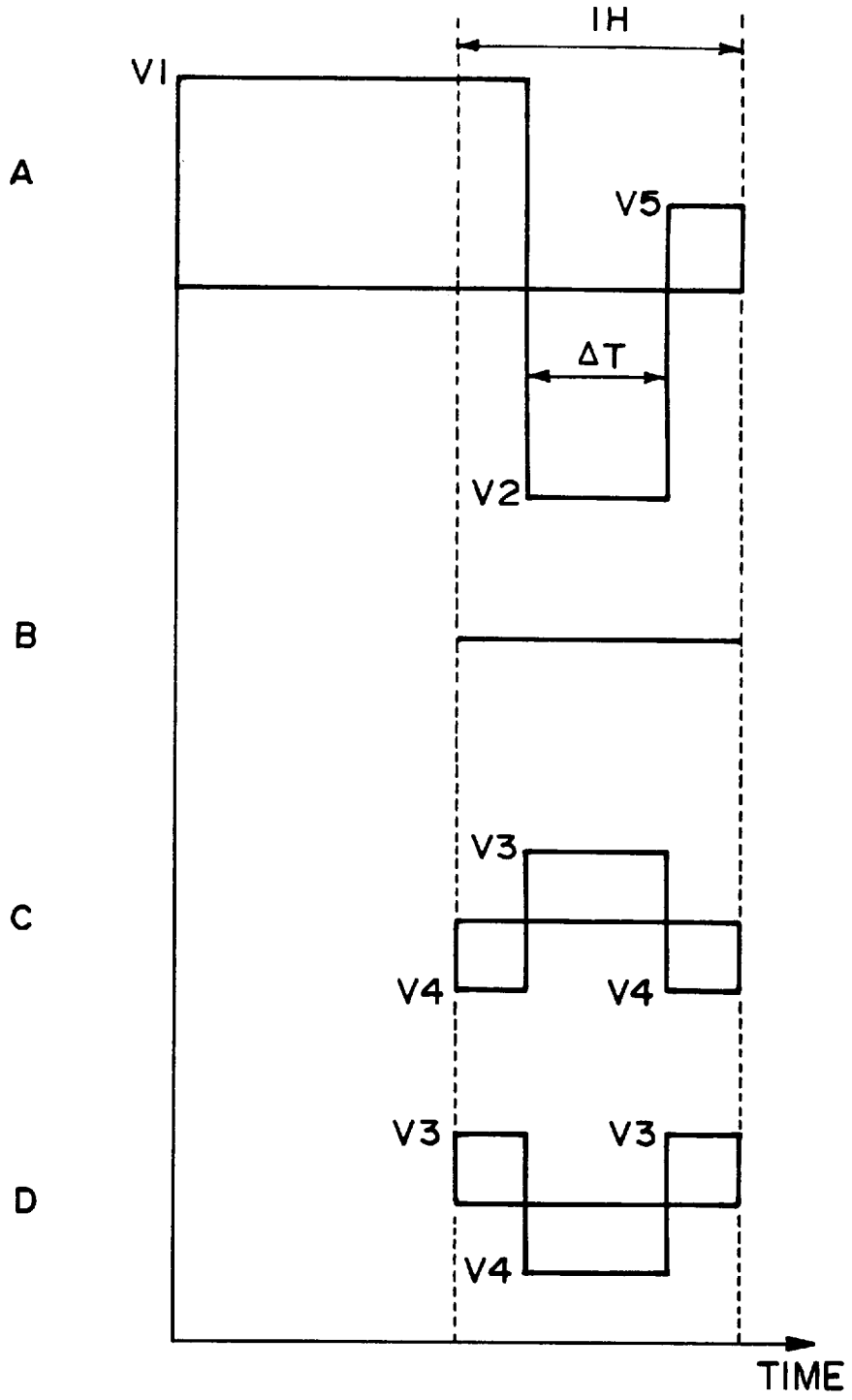

FIG. 6 shows another example set of a scanning signal and data signals. At A is shown a scanning selection signal comprising a reset pulse V1 for resetting into a dark state, a writing pulse V2 and an auxiliary pulse V5. At B is shown a scanning non-selection signal. At C is shown a data signal for displaying a "bright" state having a DC component of zero. At D is shown a data signal for displaying a "dark" state having a DC component of zero.

Next, another pixel arrangement used in a display device of the present invention will be described.

Figure 7A:
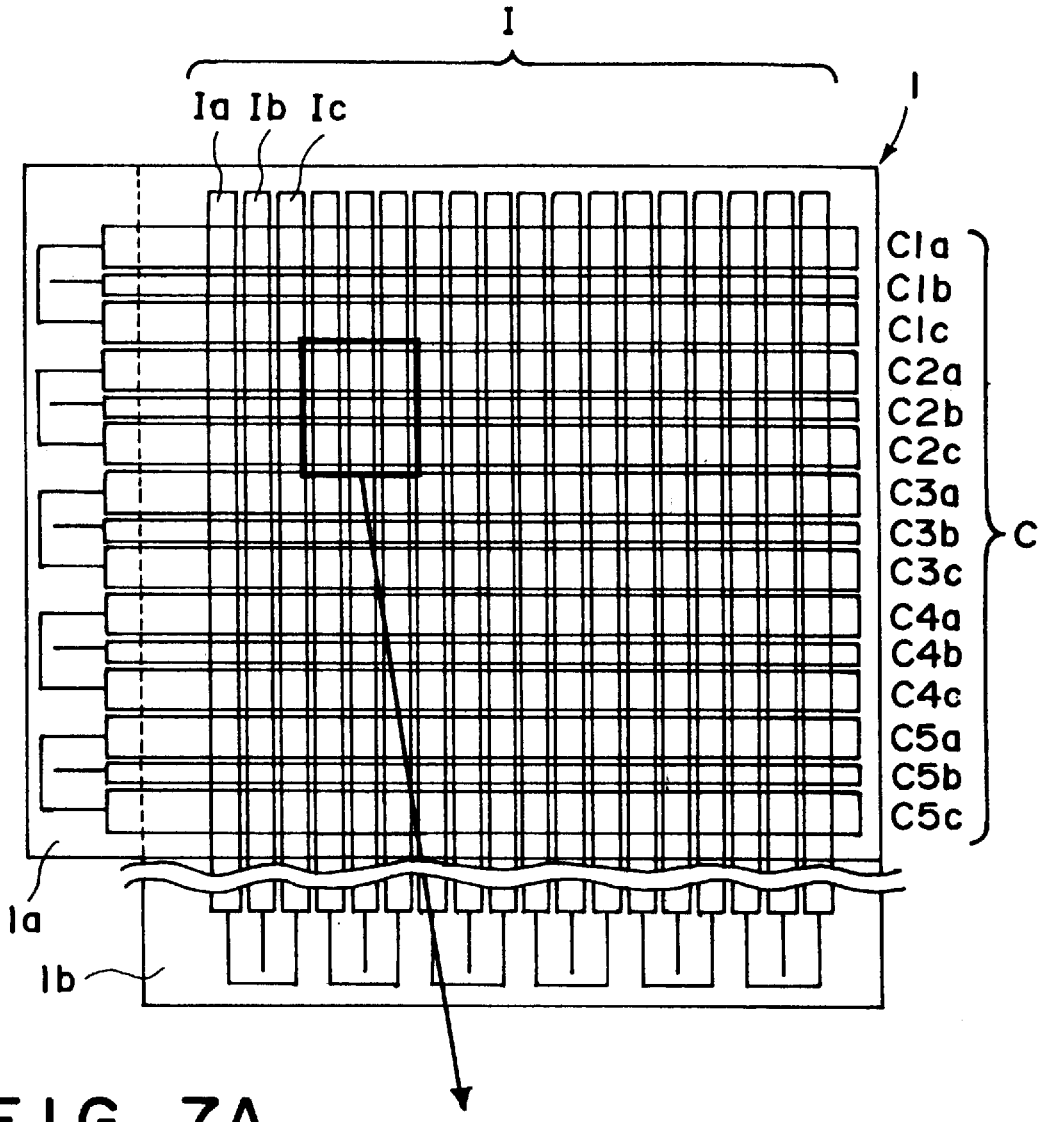
FIGS. 7A and 8A are respectively a schematic planar illustration of another example display device used in the invention and FIGS. 7B and 8B are partially enlarged views, respectively, thereof.
Figure 7B:
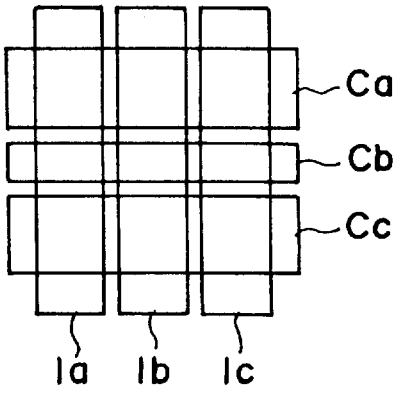

FIG. 7A is a schematic plan view of an electrode arrangement in a liquid crystal display device 1, and FIG. 7B is a partially enlarged view thereof for illustrating a pixel composed of 9 sub-pixels. As is understood from FIG. 7B, the 9 sub-pixels are designed to have different areas so as to maintain a gravity center of light quantity transmitted through each pixel always at the enter of the pixel regardless of gradation levels. Further, the scanning electrodes Ca and Cc are electrically short circuited so as to simultaneously receive a scanning signal. Similarly, the data electrodes Ia and Ic are short circuited to simultaneously receive a data signal. The scanning of Cna and Cnc (n is an integer) corresponds to the a line scanning in the embodiment described hereinabove.

Figure 8A:
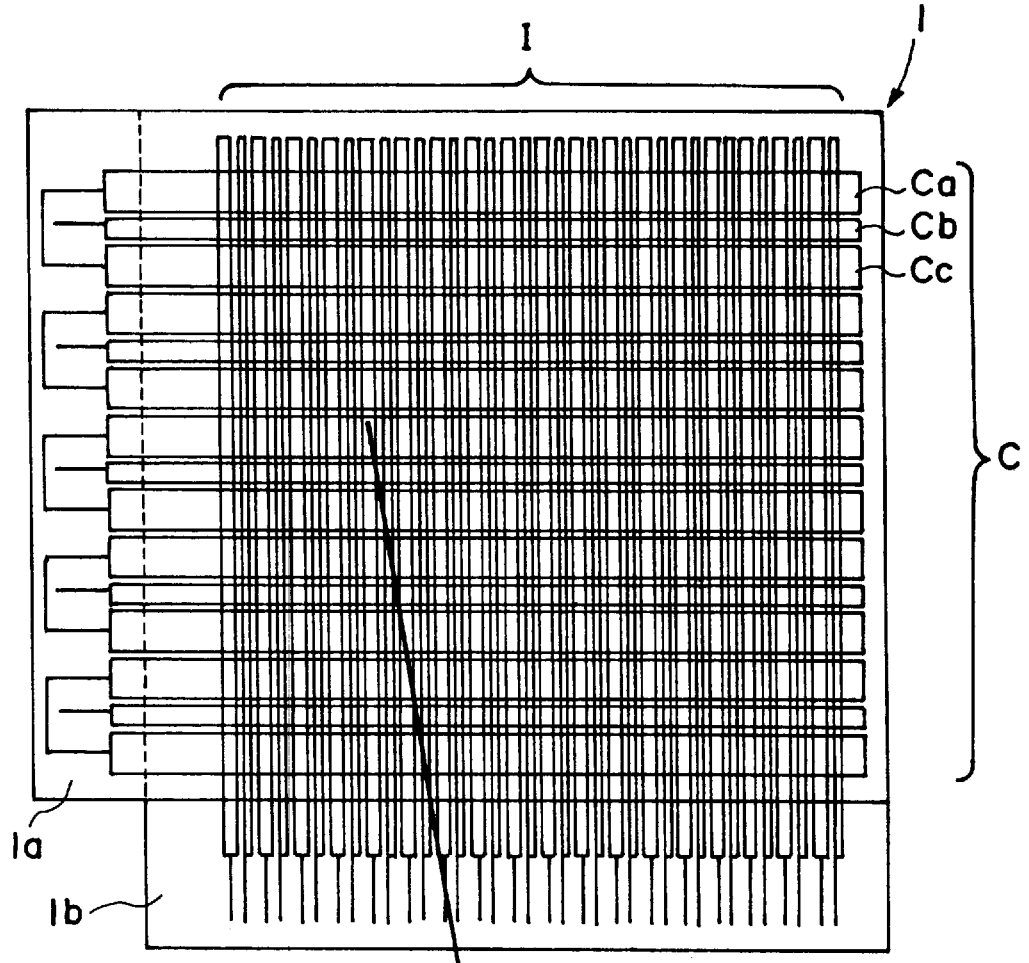
Figure 8B:
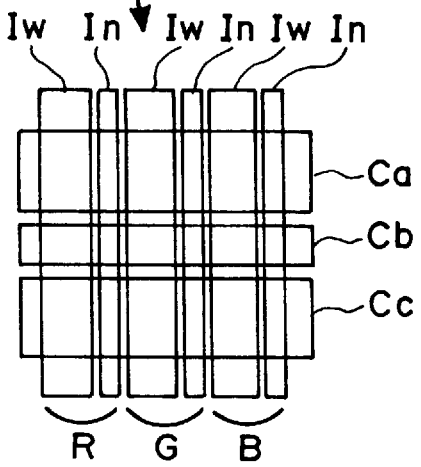

FIG. 8A is a schematic plan view of another electrode arrangement in a liquid crystal display device 1, and FIG. 8B is a partially enlarged view thereof for illustrating a color pixel unit composed of 18 sub-pixels.

As shown in FIGS. 8A and 8B, in the liquid crystal display device 1 in this embodiment, each pixel comprises 18 sub-pixels having different areas and is provided with color filter of R, G and B to constitute a color display unit. Each of R, G and B pixels is composed of two data electrodes of Iw and In having different widths and three scanning electrodes similarly as in the above embodiment including Ca and Cc which are electrically short circuited. Accordingly, each color pixel is effectively composed of two scanning lines. As a result, four bit data are displayed for each color, and totally 12 bit color data are displayed for each pixel without causing a false contour.

Figure 9:
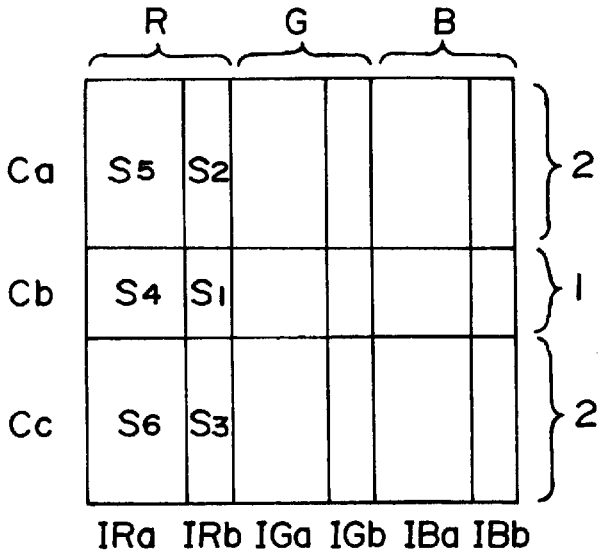
FIG. 9 is an illustration including a more detailed denotation of sub-pixels contained in a color display unit (three pixels) shown in FIG. 8B.
Figure 10:
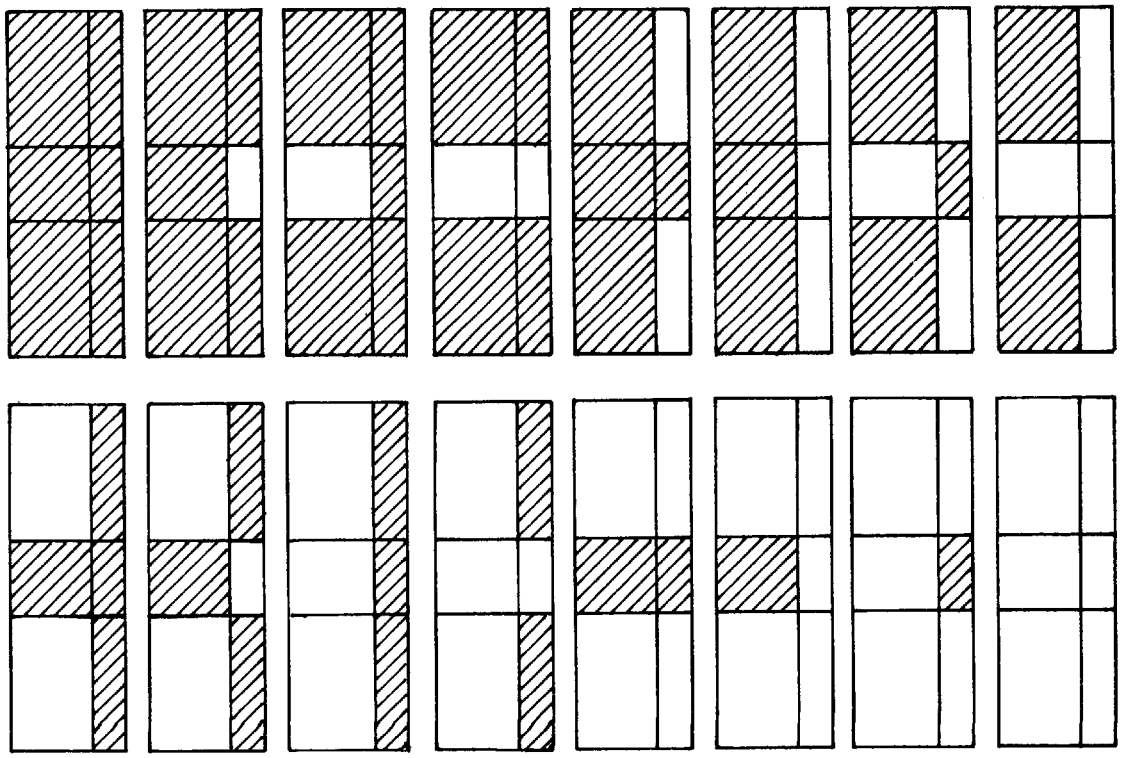
FIG. 10 is an illustration of lighting patterns of sub-pixels in a pixel corresponding to 16 gradation levels.

FIG. 9 illustrates a concept of pixel division and FIG. 10 illustrates 16 gradation levels displayed when the second display mode is adopted, respectively according to this embodiment.

According to the first display mode, the scanning electrodes Ca and Cc are selected to display four gradation levels at the maximum.

Further, in the pixel arrangement shown in FIGS. 8 and 9*m* a thin data line IBb for a blue pixel (B) can be omitted so as to display four gradation levels since a difference in gradation level cannot be readily recognized with respect to blue (B).

In this way, sub-pixels (S5 and S6) having the largest area in combination are disposed vertically in separation, and sub-pixels (S2 and S3) having a medium size are disposed on the same scanning lines as the sub-pixels S5 and S6, respectively. As a result, a gradational display can be effected even by the first display mode.

The scanning schemes and display device structures inclusive of pixel arrangements described herein may be combined appropriately in designing of display apparatus.

Now, the false contour phenomenon will be described.

Figure 11:
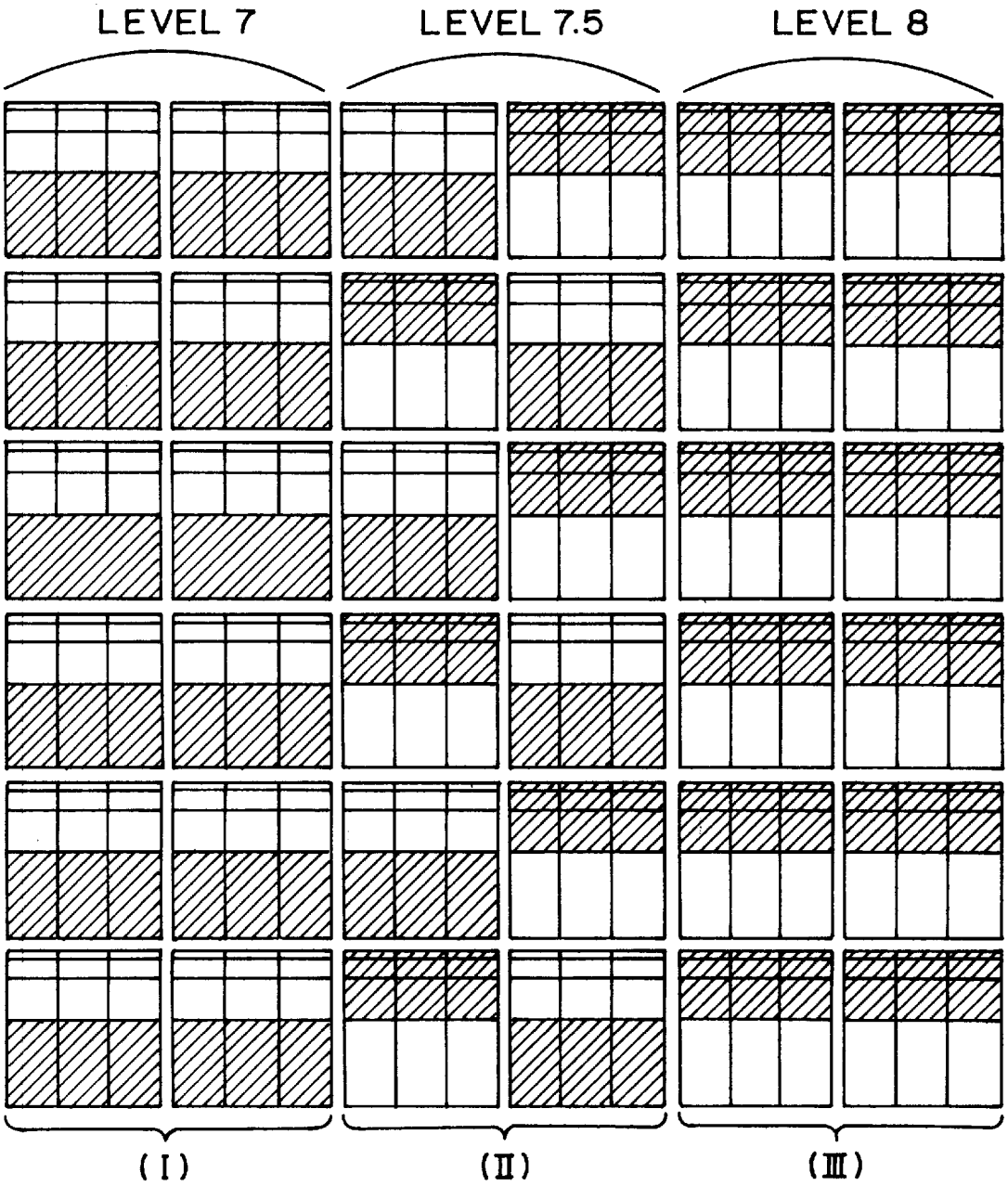
FIG. 11 is a planar illustration of a portion of display device including lighting patterns corresponding to three gradation levels for illustrating occurrence of a false contour.

For example, when pixels shown in FIG. 1A are used to display a gradation at level 7 as shown at (I) in FIG. 11, the upper part of each pixel is displayed in white. In contrast thereto, when a gradation at level 7.5 is displayed, diagonal portions in each pixel are displayed in white as shown at (II) in FIG. 11. Further, when a gradation at level 8 is displayed, a lower-part of each pixel is displayed in white as shown at (III) in FIG. 11 contrary to the case of the gradation level of 7.

As a result, in case where a center of ON region (white display portion) is noted, the center is present at an upper part at level 7, almost at the middle part at level 7.5 and at a lower part at level 8. As a result, when a natural image such as that of a photograph is displayed on the liquid crystal display device and an actual contour of the image has a varying gradation level of from 7 to 8, the center of ON (white) region is shifted by the difference in gradation so that a false contour, i.e., a contour different from the actual one, is displayed to lower the image quality. An ordinary pixel pitch is on the order of several hundred $\mu$ m, and the above-mentioned shift contour is very clearly noticed even at this level of pixel pitch, thus resulting in a false contour.

In contrast thereto, in the pixel arrangement shown in FIG. 7 or FIG. 8, a large sub-pixel is divided into two sub-pixels disposed symmetrically on both vertical sides of a smaller sub-pixel, so that the movement of gravity center of bright or dark display is suppressed when the gradation level is changed.

Hereinbelow, some specific examples are described.

EXAMPLE 1

A liquid crystal display device having a pixel arrangement as shown in FIG. 4 is driven by preferentially selecting a lines corresponding to sub-pixels having larger areas, i.e., so as to effect one frame display by three vertical scannings including two times of scanning the a lines and one time of scanning the b lines, by using a set of drive signals shown in FIG. 6.

In this case, the frame frequency may be retained at 30 Hz without lowering, thus obviating flicker. Further, by scanning the a lines having a larger contribution to the luminance at a higher frequency, a motion picture may be displayed more smoothly and at an apparently higher speed.

In actual experiments, the scanning frequency ratio for the a lines and the b lines was changed from 2:1 to 8:1. In any case, a high-quality display was realized.

EXAMPLE 2

A liquid crystal display device having a pixel arrangement as shown in FIG. 7 is driven by preferentially selecting a lines (including c lines) corresponding to sub-pixels having larger areas, i.e., so as to effect one frame display by three vertical scannings including two times of scanning the a lines (including the c lines) and one time of scanning the b lines, by using a set of drive signals shown in FIG. 6.

In this case, the frame frequency may be retained at 30 Hz to obviate flicker. Further, by scanning the a lines (inclusive of c lines) having a larger contribution to the luminance at a higher frequency, a motion picture may be displayed more smoothly and at an apparently higher speed.

In actual experiments, the scanning frequency ratio for the a (and c) lines and the b lines was changed from 2:1 to 8:1. In any case, a high-quality display was realized.

EXAMPLE 3

A display device having a pixel arrangement as show in FIG. 8 is used to effect a display.

The display device is first driven according to the second display mode, whereby all the scanning lines are scanned, and all the data lines are supplied with independent data signals to effect a gradational display at 16 levels for each of R, G and B colors.

Then, the display mode is switched by a changeover switch to the first display mode, wherein the narrower scanning lines Cb are first sequentially selected to reset the sub-pixels on the scanning lines Cb into a dark state. Alternatively, it is also possible to simultaneously select the narrower scanning lines C6 to reset the sub-pixels thereon into a dark state.

Then, the first mode display operation is effected to scan only the a and c scanning lines having a larger width. In this instance, when a binary display is desired by the operator, pairing data lines Iw nd In for each color pixel R, G or B are supplied with identical data signals. Further, when the user selects a four gradation level mode, independent data signals corresponding to given gradation levels are applied to pairing data lines for each color pixel.

In the above-described Examples 1–3, it is also possible to effect a partial rewrite drive, wherein scanning electrodes corresponding to sub-pixels having the largest area and in an image region where image data are changed are preferentially vertically scanned.

In a specific example using a device having the pixel arrangement shown in FIG. 4, a motion picture was displayed in a region comprising 100th scanning lines (C100*a* and C100*b*) to 199th scanning lines (C199*a* and C199*b*) by preferentially driving the scanning lines. In this instance, the a lines were scanned twice and then the b lines were scanned once, whereby the motion picture was displayed more smoothly.

Further, as a result of changing the a line: b line scanning frequency ratio from 2:1 to 8:1, high quality motion picture display was performed in any case.

COMPARATIVE EXAMPLE 1

A conventional full-line scanning (a–b line scanning), i.e., a scanning in the order of C1*a*→C1*b*→C2*a*→C2*b*→C3*a*→C3*b*→C4*a*→C4*b*→C5*a*→C5→. . . C480*a*→C480*b* was performed in any of the liquid crystal display devices shown in FIGS. 4, 7 and 8. (In the devices of FIGS. 7 and 8, C1*a* for example includes C1*a* and C1*c* short circuited with each other.)

As a result, flicker was observed at a frequency of 15 Hz. Further, during the vertical scanning for displaying, image data in VRAM in the data generator 7 was rewritten to cause a disruption of picture during the scanning. Thus, inferior image qualities were confirmed.

COMPARATIVE EXAMPLE 2

A liquid crystal display device having a pixel arrangement shown in FIG. 8 was driven at a high speed by selecting the a and b lines simultaneously. In this instance, the number of displayable colors was 64 (6 bits).

As a result, while a high-speed drive was possible, the number of displayable colors was remarkably reduced, and the image qualities were inferior.

As described hereinabove, according to the driving method for a display device, and the display apparatus, of the present invention, the scanning electrodes may be divided without lowering the frame frequency, thus avoiding occurrence of flicker.

Further, by preferentially scanning the scanning electrodes corresponding to sub-pixels having the largest contribution to the luminance, a display operation may be performed without causing disruption or deviation of display between frames, so that a motion picture may be displayed more smoothly and an apparently higher speed display may be possible. In other words, according to the present invention, it is possible to display high-quality images while obviating an image quality deterioration accompanying an increase in number of scanning lines.

What is claimed is:

1. A driving method for a display device of a type including scanning lines arranged to form plural pixels comprising at least two types of pixels having mutually different areas inclusive of larger pixels and smaller pixels, said driving method comprising:

driving the display device to effect a first frame display mode wherein only scanning lines corresponding to the larger pixels are vertically scanned, and driving the display device to effect a second frame display mode wherein all the scanning lines corresponding to the larger pixels and the smaller pixels are scanned to display a larger number of gradation levels than in the first display mode.

2. A driving method according to claim 1, wherein when image data is changed only for a portion of the pixels among all the pixels, only scanning lines corresponding to the larger pixels in a region including the portion of the pixels for which the image data is changed are vertically scanned.

3. A driving method according to claim 1, wherein when image data is changed for a portion of pixels among all the pixels corresponding to a number of scanning lines exceeding a prescribed number, only scanning lines corresponding to the larger pixels among the portion of pixels are vertically scanned.

4. A driving method according to claim 1, wherein for displaying a motion picture, only scanning lines corresponding to the larger pixels are vertically scanned.

5. A driving method according to claim 1, wherein two larger pixels are disposed positionally symmetrically with respect to a smaller pixel disposed between the two larger pixels.

6. A driving method according to claim 1, wherein at least two adjacent scanning lines among the scanning lines corresponding to the larger pixels are simultaneously supplied with a scanning selection signal.

7. A driving method according to claim 1, wherein the scanning lines corresponding to the larger pixels are vertically scanned with skipping of at least one scanning line in a prescribed region and without skipping in another region.

8. A driving method according to claim 1, wherein said pixels comprise a chiral smectic liquid crystal.

9. A driving method according to claim 1, wherein said display device comprises a pair of substrates and a chiral smectic liquid crystal disposed in a bookshelf layer structure between the substrates.

10. A driving method according to claim 1, wherein said display device comprises a pair of substrates and a chiral smectic liquid crystal having a phase transition series lacking cholesteric phase disposed between the substrates.

11. A driving method according to claim 1, wherein said display device comprises a pair of substrates and a chiral smectic liquid crystal disposed between the substrates, only one of the substrates having been subjected to rubbing.

12. A driving method according to any one of claims 1–11, wherein said plural pixels include a unit of pixels comprising a smaller pixel, at least two larger pixels disposed positionally symmetrically with respect to the smaller pixel, and a medium pixel having a smaller area than the larger pixel and disposed on the same scanning line as the larger pixel.

13. A driving method according to claim 1, wherein said display device is adapted for gradational display based on given gradation data.

14. A driving method according to claim 1, including, as selective modes, a first mode of effecting a gradational display at a first number of gradation levels, and a second mode of effecting a gradational display at a second number less than the first number of gradation levels or a binary display.

15. A driving method according to claim 1, wherein said plural pixels include color pixels of red, blue and green.

16. A driving method according to claim 1, wherein said plural pixels include color pixels of red, blue and green each adapted for gradational display, one of the red, blue and green color pixels having a number of gradation levels different from those of the other color pixels.

17. A driving method according to claim 1, wherein said scanning lines corresponding to said larger pixels also have thereon pixels smaller than said larger pixels.

18. A driving method according to claim 1, wherein said plural pixels include a unit of pixels including pixels having different areas disposed on an identical scanning line which receive identical data signals.

19. A driving method according to claim 1, wherein said plural pixels include a unit of pixels including pixels having different areas disposed on an identical scanning line which receive different data signals.

20. A display apparatus, comprising:

a display device including scanning lines arranged to form plural pixels comprising at least two types of pixels having mutually different areas inclusive of larger pixels and smaller pixels, and drive means for driving the display device according to a driving method of claim 1.

21. A driving method for display device of a type including a pair of oppositely disposed substrates having thereon a group of scanning electrodes and a group of data electrodes intersecting the scanning electrodes so as to form a sub-pixel at each intersection of the scanning electrodes and the data electrodes, a plurality of the sub-pixels having different areas forming one of plural pixels, said driving method comprising selectively driving the scanning electrodes and the data electrodes depending on given image data so as to turn on the sub-pixels in various patterns to display multiple gradation levels at each of the plural pixels, said driving method including one frame period comprising a plurality of fields wherein a scanning electrode corresponding to a sub-pixel having the largest area among the plurality of sub-pixels is scanned in a larger number of fields than a scanning electrode corresponding to a sub-pixel having the smallest area among the plurality of sub-pixels.

22. A driving method according to claim 21, wherein a scanning electrode corresponding to a sub-pixel having the largest area among the plurality of sub-pixels and present in an image region for which image data is changed is preferentially scanned to effect a vertical scanning for providing one frame of display.

23. A driving method according to claim 21 or 22, wherein said scanning electrode corresponding to the sub-pixel having the largest area is scanned a larger number of times than the other scanning electrodes in one frame period.

24. A display apparatus, comprising:

a display device including a pair of oppositely disposed substrates having thereon a group of scanning electrodes and a group of data electrodes intersecting the scanning electrodes so as to form a sub-pixel at each intersection of the scanning electrodes and the data electrodes, a plurality of the sub-pixels having different areas forming one of plural pixels, and drive means for driving the display device according to a display method of claim 21.

25. A driving method for a display device of a type including scanning lines arranged to form plural pixels comprising at least two types of pixels having mutually different areas inclusive of larger pixels and smaller pixels, said driving method comprising driving the display device to effect period comprising at least three fields wherein only scanning lines corresponding to the larger pixels are vertically scanned in each of two of said at least three fields, and only scanning lines corresponding to the smaller pixels are vertically scanned in a remaining one of said at least three fields.

26. A display apparatus, comprising:

a display device including scanning lines arranged to form plural pixels comprising at least two types of pixels having mutually different areas inclusive of larger pixels and smaller pixels, and drive means for driving said apparatus to effect one frame period comprising at least three fields wherein only scanning lines corresponding the larger pixels are vertically scanned in each of two of said at least three fields, and only scanning lines corresponding to the smaller pixels are vertically scanned in a remaining one of said at least three fields.

* * * * *

UNITED STATES PATENT AND TRADEMARK OFFICE

CERTIFICATE OF CORRECTION

PATENT NO. : 5,808,594

DATED : September 15, 1998

INVENTOR(S) : AKIRA TSUBOYAMA ET AL.

It is certified that error appears in the above-identified patent and that said Letters Patent is hereby corrected as shown below:

COLUMN 2

Figure 2:
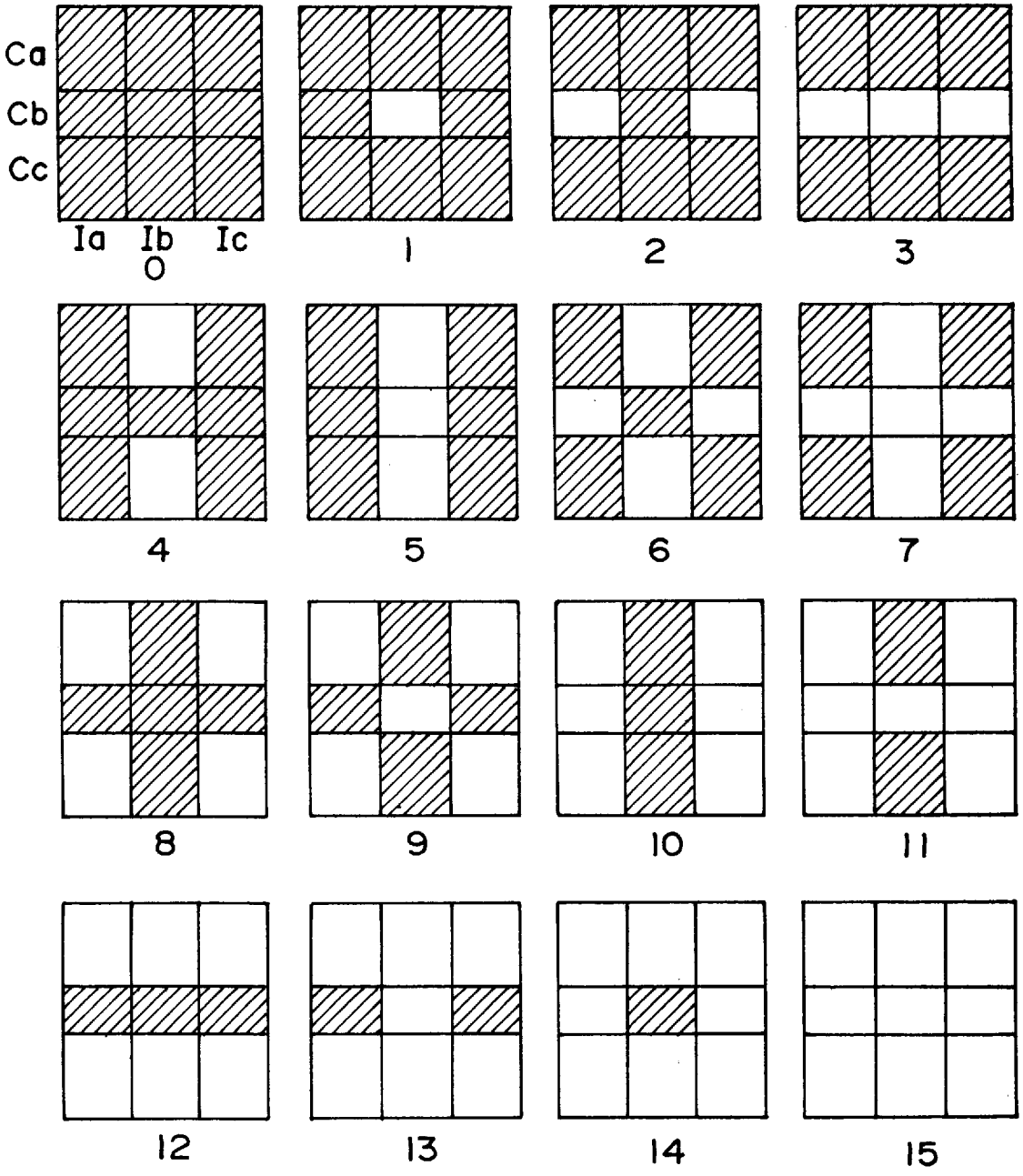
FIG. 2 shows 16 sub-pixel lighting patterns corresponding to 16 gradation levels.

Line 20, "FIG. 2. White" should read --FIG. 2, white--.

COLUMN 4

Line 7, "la" should read --1a--.

COLUMN 8

Line 38, "films," should read --film,--.

COLUMN 9

Line 9, "enter" should read --center--.
Line 61, "lower-part" should read --lower part--.

COLUMN 10

Line 7, "$\mu$ m," should read --$\mu$m,--.

COLUMN 11

Line 4, "Iw nd In" should read --Iw and In--.

UNITED STATES PATENT AND TRADEMARK OFFICE

CERTIFICATE OF CORRECTION

PATENT NO. : 5,808,594

DATED : September 15, 1998

INVENTOR(S) : AKIRA TSUBOYAMA ET AL.

It is certified that error appears in the above-identified patent and that said Letters Patent is hereby corrected as shown below:

COLUMN 14

Line 25, "period" should read --one frame period--.

Signed and Sealed this

Thirteenth Day of July, 1999

*Attest:*

*Attesting Officer*

Q. TODD DICKINSON

*Acting Commissioner of Patents and Trademarks*